US007883001B2

(12) United States Patent
Goodrich

(10) Patent No.: US 7,883,001 B2
(45) Date of Patent: Feb. 8, 2011

(54) CORRUGATED SHIPPING CONTAINER SYSTEM

(76) Inventor: David Goodrich, 14 Ox Hill Rd., Newton, CT (US) 06470

( * ) Notice: Subject to any disclaimer, the term of this patent is extended or adjusted under 35 U.S.C. 154(b) by 1119 days.

(21) Appl. No.: 11/505,208

(22) Filed: Aug. 16, 2006

(65) Prior Publication Data

US 2008/0041926 A1 Feb. 21, 2008

(51) Int. Cl.
*B65D 5/56* (2006.01)
*B65D 5/32* (2006.01)

(52) U.S. Cl. ..... 229/122.33; 229/122.32; 229/199; 229/923

(58) Field of Classification Search ..... 229/122.32, 229/122.33, 939, 199; 206/600; 428/182, 428/184

See application file for complete search history.

(56) References Cited

U.S. PATENT DOCUMENTS 1,809,953 A * 6/1931 Witte ..... 229/939
1,971,863 A * 8/1934 Lupton ..... 229/122.34
2,895,541 A * 7/1959 Spivack ..... 229/122.33
3,063,615 A * 11/1962 Bronte et al. ..... 229/122.32
4,177,895 A * 12/1979 Shelton ..... 206/386
4,341,337 A * 7/1982 Beach et al. ..... 229/122.32
5,133,460 A * 7/1992 Shuert ..... 206/600
6,138,903 A * 10/2000 Baker ..... 229/122.33
7,163,122 B2 * 1/2007 Elder et al. ..... 229/939
7,604,156 B2 * 10/2009 Clohessy ..... 229/122.32

* cited by examiner

*Primary Examiner*—Gary E Elkins
(74) *Attorney, Agent, or Firm*—Sheldon H. Parker, Esq.

(57) ABSTRACT

The disclosure indicates that the compression strength of a corrugated shipping crate can be increased through the use of horizontal panels adhered to the inside surface of the vertically fluted outer walls of the crate. The panels can comprise a layer of horizontally fluted single layer of double wall or triple wall corrugated, and a layer of vertically oriented double or triple wall corrugated. The crates' outer walls can be vertically fluted 1100 weight corrugated or less. The double wall vertically fluted corrugated, can be corrugated board have a weight in the range from 500 to 1100 pounds.

19 Claims, 8 Drawing Sheets

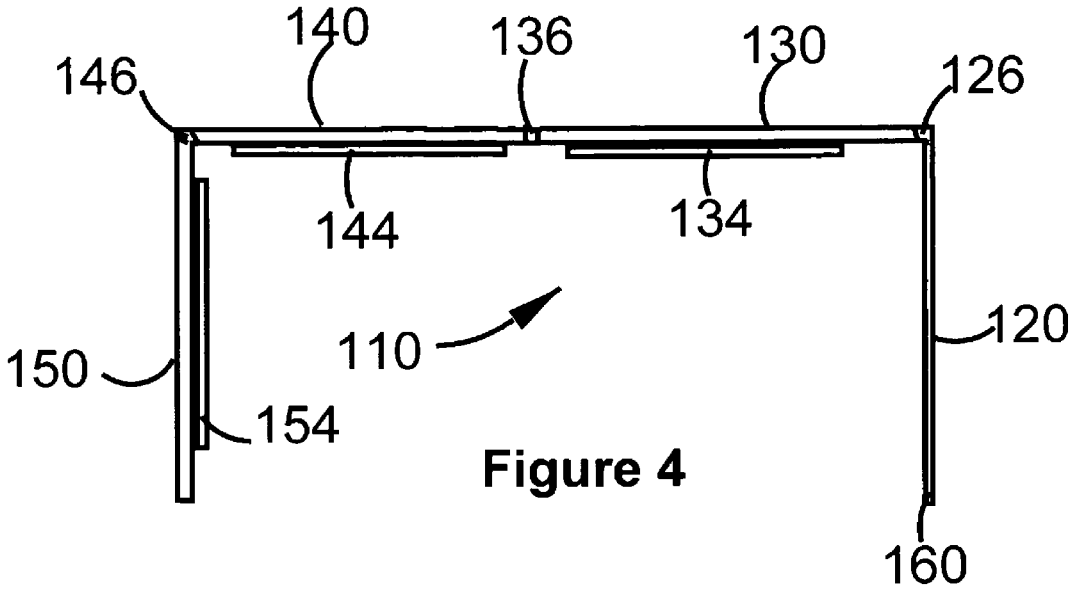
Figure 4
Figure 5
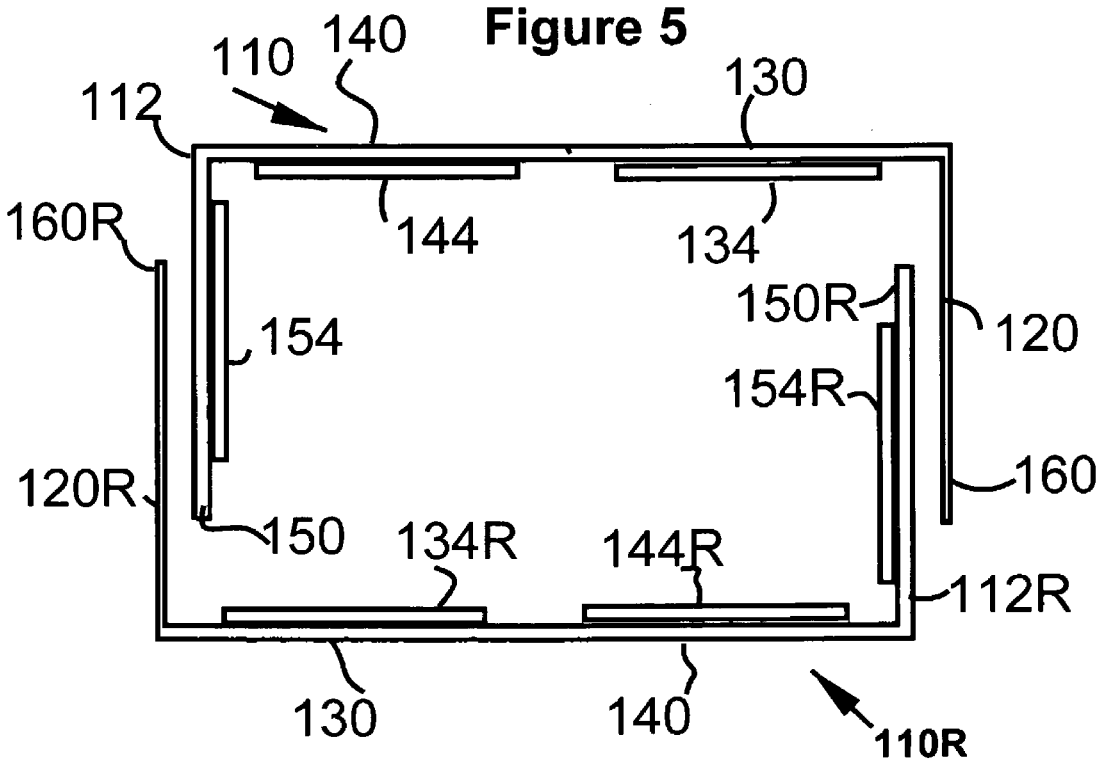

CORRUGATED SHIPPING CONTAINER SYSTEM

CROSS-REFERENCE TO RELATED APPLICATIONS

This application incorporates herein by reference, as though recited in full, the disclosures of patent application Ser. No. 10/979,138, filed Nov. 3, 2004, having the title, "CORRUGATED SHIPPING CONTAINER SYSTEM" and provisional patent application 60/516,700 filed Nov. 3, 2003. This application claims the benefit of provisional patent application 60/708,663 filed Aug. 16, 2005, the disclosure of which is incorporated herein by reference.

GOVERNMENT INTEREST STATEMENT

None

BACKGROUND

1. Field of the Invention

The invention relates to a shipping crate formed from sheets of corrugated material, such as paper board, and in particular to a crate whose design optimizes compression strength relative to the amount of material that is use to make the crate.

2. Brief Description of the Prior Art

Shipping crates made from corrugated board are gaining popularity over wooden crates due to weight benefits as well as concerns of insects being carried in the wood. The crates are manufactured so that the flutes of the corrugated board are vertical, because it is well known that the vertically orientation can support far more weight than horizontally oriented fluting. The compression strength, or load bearing strength, of corrugated board crates is then strengthened by adding additional corrugate layers and/or by increasing the weight of the corrugated board that is used.

The need for high load bearing strength is based on the fact that crates are frequently stacked in storage and during shipment. Crates may be stacked two or three high, and instances they can be stacked four high. The bottom crate must support the weight of all of the crates above it.

A cargo carrier is typically a metal shipping container and shipping crates are generally manufactured to have dimensions such as that, in combination, they will substantially fill the 8×8×40 ft. interior space the cargo carriers. The crates can be any combination of sizes that readily combine to fill the 8×8×40 foot interior. In those instances where the interior space of the cargo transporter is other than a standard 8×8×40 feet, then the crate can be dimensioned to correspond to the interior dimension of the cargo transporter. Long distance shipping crates, and particularly crates for international shipping of goods, are predominantly designed to provide, approximately, an eight foot, by eight foot, by four foot interior space.

The container capacity is the total cubic volume (cube) a container can accommodate, or the cubic measurement of cargo. The capacity (i.e., the internal volume) is determined by multiplying the internal dimensions, that is, the product of internal length, width and height. The capacity may vary among containers of the same specified length and height.

The use of two or three layers of corrugated paper significantly increasing the crush strength. As the cost of the crate is directly related to the amount of corrugated paper that is used.

the material cost of a double wall 1,300 pound paper would about two thirds the cost of a 1,300 pound triple wall corrugated paper.

A double wall corrugated has two outer layers of flat sheet material, two layers of fluted sheets and a third layer of flat sheet material between the two fluted layers. A triple wall panel has two outer layers of flat sheet material, three layers of fluted sheets and two layers of flat sheet material separating the three fluted layers. A triple wall panel thus has a flat sheet, fluted sheet, flat sheet, fluted sheet, flat sheet, in that order. As the flat sheets use less material per running foot than a fluted sheet, the triple wall has very nearly one third more material than a double wall, which is reflected in the cost. The weight of the corrugated material will also be reflected in the price. Corrugated sheet that are classified as 1,000 weight would cost double that of 500 weight corrugated.

The compression resistance of crates can be tested by using r ASTM D4169/D642. Failure of crates tested under ASTM D4169/D642, occurs when the crate compresses to any extent. The tests are all run to failure and since the tests are run in twenty pounds increments, the compression prior to failure, that is, the maximum compression strength, is twenty pounds less than compression at failure.

SUMMARY

The present invention relates to a crate having a base, four sides, and a top cap. A first panel and a second panel form the four sides. Each of the two panels has a first, a second and a third sub-panel. The first sub-panel of the first panel is positioned to overlap, or overly the third panel of the second panel. The second sub-panel of the first panel and the second sub-panel of the second panel have substantially identical dimensions, the of the first panel and the first sub-panel of the second panel have substantially identical dimensions, and the third sub-panel of the first panel and the third sub-panel of the second panel have substantially identical dimensions. Preferably, the first sub-panel is less than one half the width of the third sub-panel but at least twenty percent of the width of the third sub-panel. Essentially, the first panel and the second panel are interchangeable.

The upper and lower ends of the crate are enclosed with end caps, and the base panel of at least double wall corrugated paper is positioned on the lower end cap. The lower or bottom end cap is positioned on the skid. The base panel has peripheral dimensions that are substantially equal to the interior dimensions of the crate. Thus, the first and second panels are held between the base panel and the lower end cap.

The crate is used in combination with a skid for shipping cargo. The cargo can be a plurality of items that are individually packaged or wrapped with a cushioning material, or a combination thereof.

Surprisingly, it has now been found that a crate made from an outer shell of vertically fluted corrugated board in combination with horizontally oriented inner panels, can provide greater compression strength than its vertical-vertical counter part. As for example, a 1100 weight triple wall layer in combination with a 500 weight double layer has a higher compression resistance than same size crates formed from two layers of 1300 weight triple wall.

It has also be found that, using the disclosed system, a crate made from the combination of 1100 weight triple wall outer layer and an inner layer of 500 weight double layer has a higher compression resistance than same size crates formed from the combination of a layer of 1300 triple wall and a 500 inner layer.

It is extremely surprising that a 1300-1300 crate (combined weight of 2600) has a compression rating in pounds of 12940, while a 1100-500-1100 (combined weight of 2700) has a compression rating of 22,690. The compression rating is in accordance with Military approved testing standard ASTM D4169/D642.

In one broad aspect of the disclosure, a shipping crate is formed from an eleven hundred or less outer layer, in combination with an eleven hundred or less inner layer.

In another broad aspect of the disclosure, a shipping crate is made from an outer layer of double wall or triple wall, in combination with a double or triple wall inner layer. The flutes in the outer layer run vertically, while the flutes in the inner layer run horizontally.

In another broad aspect of the disclosure, a shipping crate is made from two outer panels, each panel having a "U" configuration. That is, each panel has two outer subpanels and a sub-panel contiguously between the two outer panels. The panels are, in essence, mirror images of each other. The outer sub-panels on one panel overly, One of the outer panel layers of double wall or triple wall, vertically oriented corrugated, in combination with a double wall horizontally oriented corrugated inner layer.

BRIEF DESCRIPTION OF THE DRAWINGS

The invention will be described in conjunction with the accompanying drawings, in which:

FIG. 4 is a plan view of the embodiment of FIG. 2 folded to its C configuration in accordance with an embodiment of the invention;

FIG. 5 is a top view of two C walls of FIG. 6C being placed together to form the container of FIG. 7 in accordance with and embodiment of the invention;

DETAILED DESCRIPTION

It is advantageous to define several terms before describing the invention. It should be appreciated that the following definitions are used throughout this application.

Definitions

Where the definition of terms departs from the commonly used meaning of the term, applicant intends to utilize the definitions provided herein, unless specifically indicated otherwise.

As employed herein, the term "corrugate paper" and the term "corrugated board" are used interchangeably, and are inclusive of single, double and triple wall corrugated materials for shipping crates, as well known in the art.

As employed herein, the term "crate" refers to an enclosure of any size or shape formed from a base an end cap and a pair of panels. Typically, the base is a second end cap. A crate formed from two end caps and two J panels, or two "U" panels.

Figure 9:
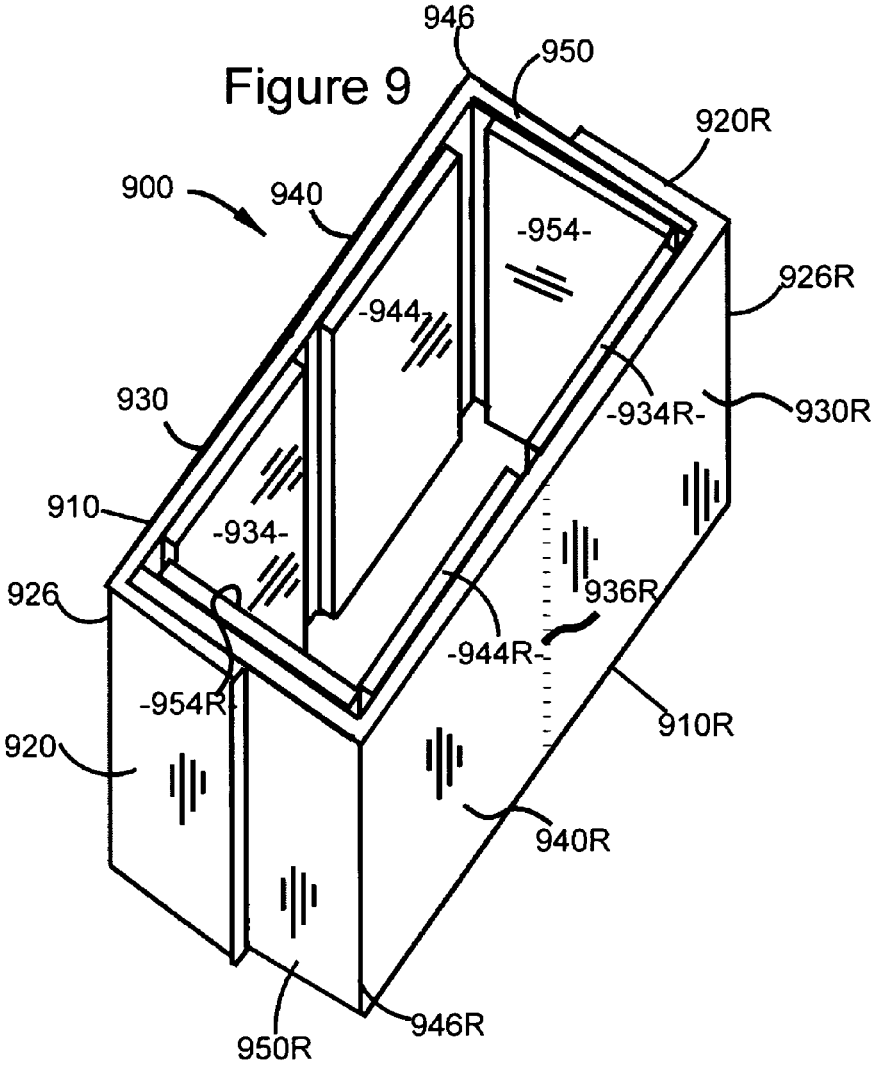
FIG. 9 is a perspective view of a partially assembled crate have having different length end sub-panels in accordance with and embodiment of the invention.

As employed herein, the term "overlap" refers to the side-by-side arrangement of a panel or sub-panel of a wall of a crate, and a sub-panel or panel of another wall of a crate. The term overlap is used interchangeably with the term "superjacent" meaning to lie over, upon, or overlying. FIG. 9 shows end panels of walls 902 and 900, superjacent with each other.

As employed herein, the term "J" panel refers to a panel having at least one corner turn, that is, an L shaped corner. The term is inclusive of a panel having two corner turns in the form of a "J" or a ⊔ which, for simplicity, is referred to as a "U". An inner subpanel is preferably longer than the other two panels, but the two arms of the U can be the long sides of a crate. Fold lines separate the three subpanels, and the two outer sub-panels are contiguous with the inner one or two sub-panels. A "J" crate can have two outer panels of unequal dimensions. Depending upon the dimensions of a crate, the base of the "J" can be the longer of the sidewalls of a crate. In a four-foot crate, there may be three panels of roughly the same length.

As employed herein, the term "scored" when used with respect to corrugated panels, is inclusive of an elongated crushing of the corrugated material to form a region about which subpanels can be folded to form an "L", a "U" or a "J" shaped configuration.

As employed herein, the term "contiguous" refers to components that have been constructed integrally with an adjacent component, as for example, the subpanels of a panel having multiple parts. Contiguous subpanels are separated by score lines that facilitate the forming of corner folds and folds for storage and/or shipping of corrugated board to an assembly facility.

As employed herein, the term "single wall" refers to corrugated material that has one corrugated layer and two outer flats sheets.

As employed herein, the term "double wall" refers to corrugated material that has two corrugated layers separated by a flat sheet and two outer flats sheets.

As employed herein, the term "triple wall" refers to corrugated material that has three corrugated layers, with each layer being separated by a flat sheet and two outer flats sheets, thus providing four flat sheets and three corrugated sheets.

As employed herein, the designation of "1,300 weight paper", indicates that 1,000 square feet of the paper from which the flutes are made and weighs 1,300 pounds. Similarly, the designation "1,100" indicates that 1000 square feet of the sheet material weighs that 1,100 pounds. It is noted that, by way of contrast, the weight of Kraft paper is based on paper weight, per 3,000 square feet.

As employed herein, the term "flute" refers to the layer of corrugated board that typically is used with two outer layers of flat sheets.

Description of Embodiments of the Invention

The invention relates to the design and manufacturing of cross core panel crates and a system of shipping these crates as folded corrugated panels, preferably on a skid, prior to assembly. The disclosed crates provide higher crush resistance than prior art crates at a lighter weight.

Figure 1:
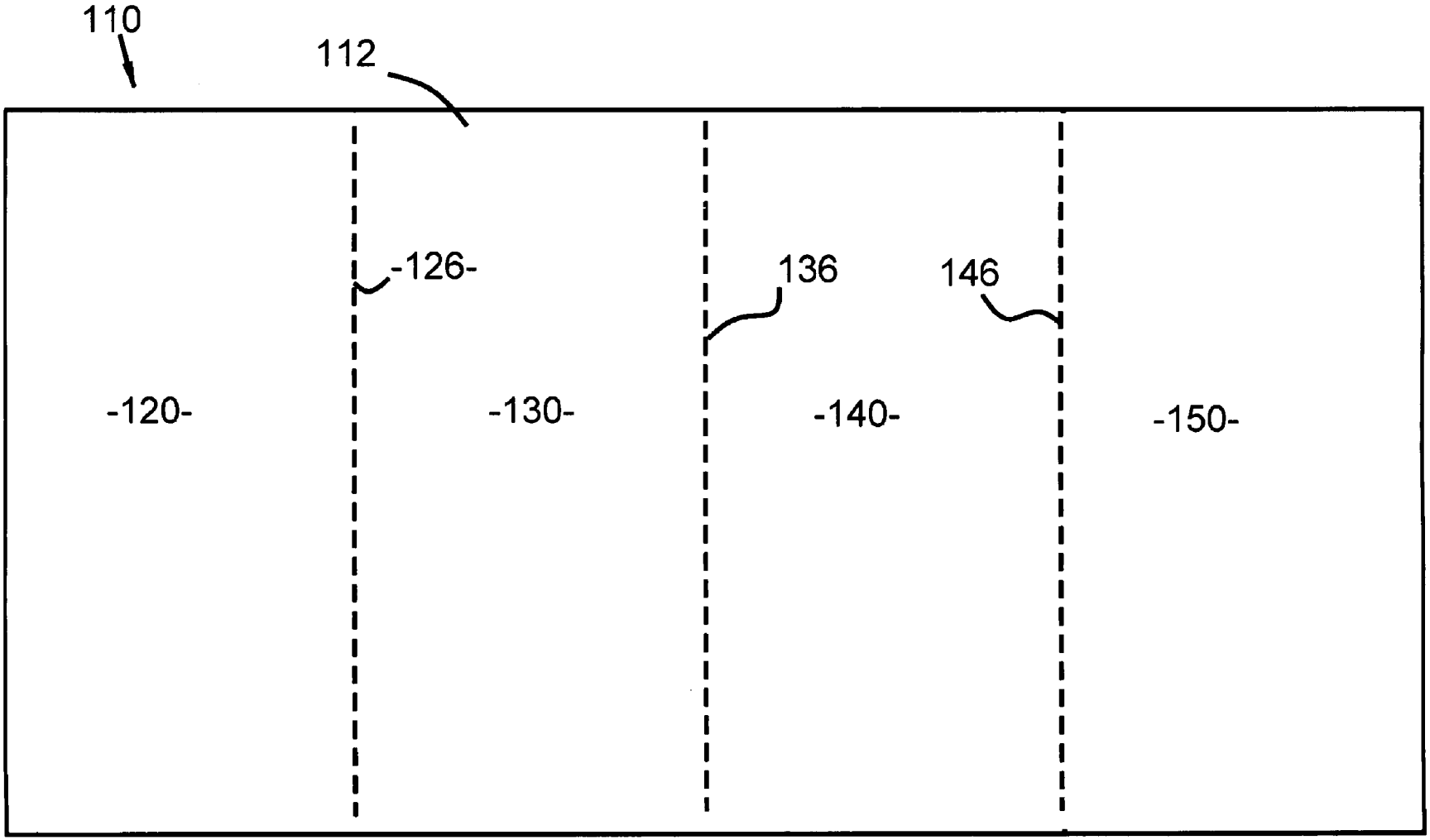
FIG. 1 is a plan view of an embodiment showing a pre-folded C wall with three score lines dividing the wall into four sub-panels in accordance with an embodiment of the invention.

FIG. 1 illustrates the exterior face 112 of panel 110 that forms vertical walls of the cross core panel crate in the unfolded position, ready for assembly. The panel 110 is divided into four sub-panels, 120, 130, 140 and 150 by score lines 126, 136 and 146. Each crate is made up of two panels 110, each having four (4) sub-panels 120, 130, 140 and 150, created by three (3) score lines 126, 136, 146. The score lines 126 and 146 enable the sub-panel 110 to be folded into the C shape to form the crate, as described herein after. The center score line 136, in conjunction with the outer score lines 126 and 146, enables the panel 110 to be folded into the compact shipping formation as illustrated hereinafter in 8A and 8B.

Figure 2:
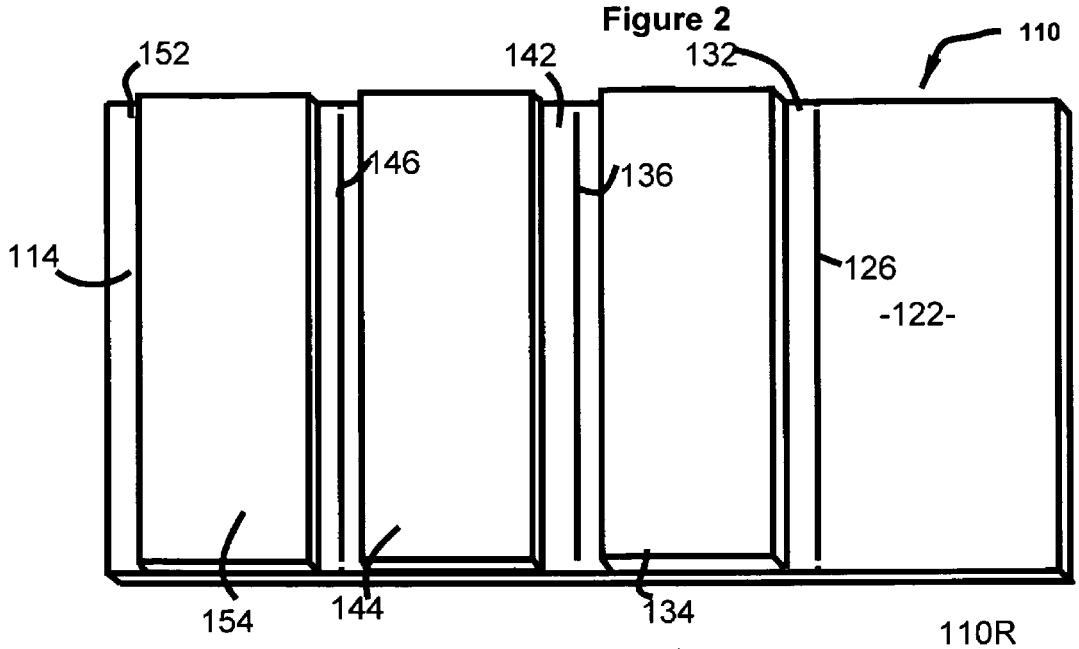
FIG. 2 is plan view of an embodiment showing three horizontal inner panels adhered to three wall sub-panels in accordance with an embodiment of the invention.
Figure 3:
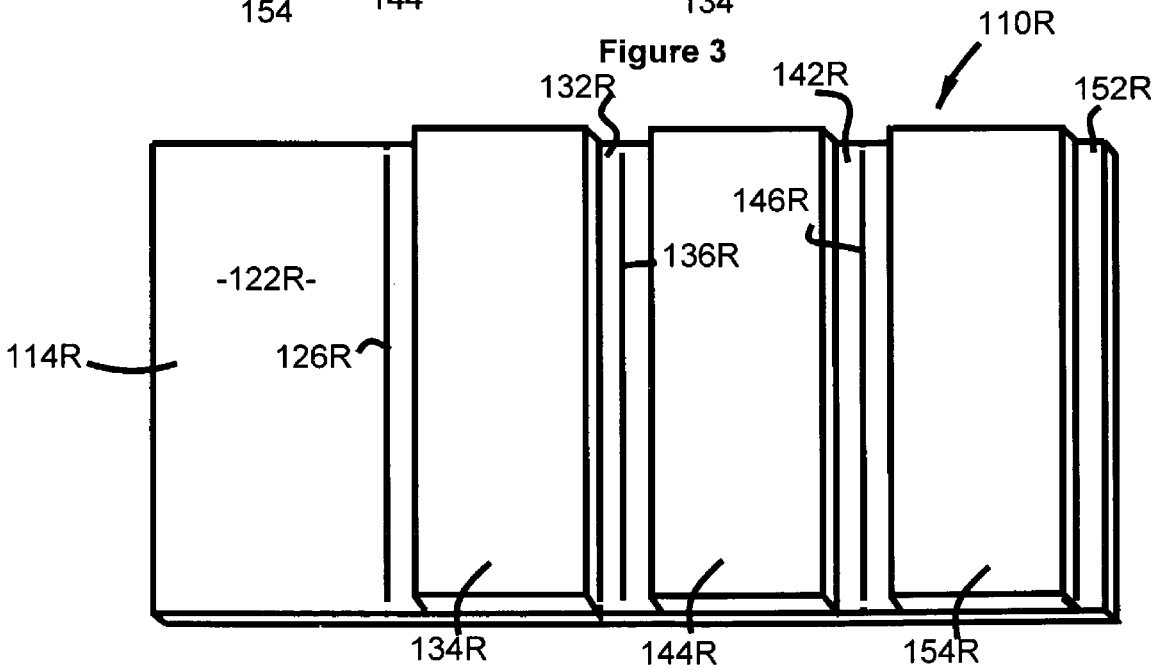
FIG. 3 is plan view of an embodiment showing three horizontal inner panels adhered to three wall sub-panels in a configuration that is the reverse of the configuration of FIG. 2. The C walls of FIGS. 2 and 3 are identical is plan view of an embodiment showing three horizontal inner panels adhered to three wall sub-panels in accordance with an embodiment of the invention.

FIGS. 2 and 3 illustrate the inner face 114 and 114 of the panels 110 and 110R that are used to form the crate. Score line 126 separates the contiguous sub-panels 122 and 132; score line 136 separates contiguous sub-panels 132 and 142R and score line 146 separates sub-panels 142 and 152. To provide the strength required for a shipping crate, horizontally fluted panels 134, 144, and 154 are adhered to the sub-panels 130, 140 and 150, respectively. The fluted panels 134, 144 and 154 are adhered proximate the center of the sub-panels 130, 140 and 150. The fourth panel 122 remains open and does not receive a fluted panel in order to provide the overlap with the second panel 110R.

As seen in FIG. 3, the second panel 110R forming the crate is illustrated. In most embodiments the first panel 110 and second panel 110R are identical, however it could be seen in some embodiments where irregular crates are required that the two panels could be dimensioned differently. The corresponding designations for the sub-panels in FIG. 3 on the interior surface 114R are 122R, 132R, 142R and 152R. Score line 126R separates the contiguous sub-panels 122R and 132R; score line 136R separates contiguous sub-panels 132R and 142R and score line 146R separates sub-panels 142R and 152R. As with the first sub-panel 110, three of the four sub-panels, 132R, 142R and 152R have horizontally fluted panels 134R, 144R and 154R, respectively, adhered at approximately the middle. It should be noted that the configuration of the horizontally fluted panels 154, 144, 134 and 154R, 144R, 134R in FIGS. 2 and 3, are actually identical. When the wall forming panel, indicated generally by arrow 110 in FIG. 2 is rotated 180 degrees, it is identical to wall forming panel 110R of FIG. 3. Accordingly, pair of the panels 110 and 110R is used to form a crate such as illustrated in FIG. 5.

In FIG. 4 panel 110 is illustrated in the folded position. As can be seen, the fluted panels 154, 144 and 134 face the interior of the crate. Sub-panel 150 is folded at score line 146 to form one end of the crate. Score line 136 is not folded once the panel 110 is being assembled into a crate and is only used for the shipping process that is described further hereinafter. Sub-panel 120 is folded at score line 126 to form the overlap end 160 to the crate.

FIG. 5 illustrates the wall panel unit 110R folded and placed to interact with the panel 110. The two wall units 110 and 110R come together to form the crate with overlap panel 160 being adhered to the exterior 112R of sub-panel 150R and the overlap panel 160R being adhered to the exterior surface 112 of sub-panel 150R.

Glue, or any other convenient bonding agent adheres the horizontal fluted panels 154, 144,134, to the wall panels 110 and 110R. Similarly, glue, or any other bonding agent adheres horizontal fluted panels 154R, 144R and 134R to the wall panel 110R. Additionally, glue or any other convenient bonding agent is used to adhere the overlap panel 160 to the sub-panel 150R and the overlap panel 160R to the sub-panel 150. The method of adhering the horizontal fluted panels to a wall panel and the overlap panels to the wall panels is not narrowly critical. One skilled in the art can use any convenient method of securing the horizontal sub-panels to a wall panel.

While triple wall corrugated paper is a preferred material for the wall panels, such as 110 and 110R, double wall corrugated board can also be used.

Figure 6:
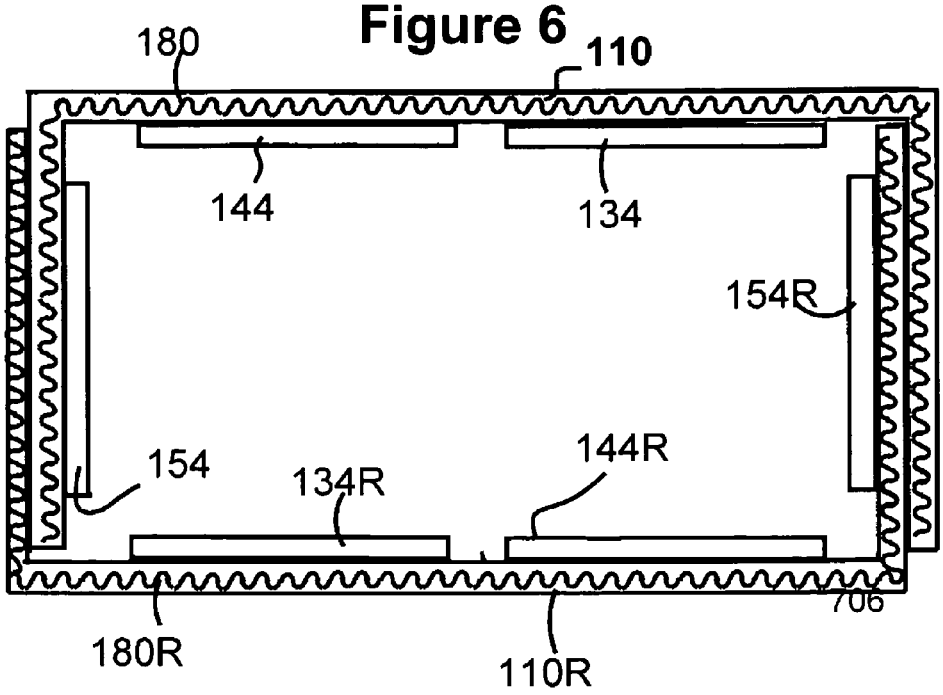
FIG. 6 is a top cross sectional view of the two C walls of FIG. 5 adhered together to form a corrugated crate in accordance with and embodiment of the invention.

FIG. 6 shows the flute orientation of wall panel 110 and wall panel 110R. The horizontal panels 134, 144, 154, 134R, 144R and 154R do not reveal their flutes because they are horizontal to the open top and bottom. Conversely, the flutes 180 of wall panel 110 are vertical, and thus are visible. Similarly, the flutes 180R of wall 110R are also visible.

Figure 7:
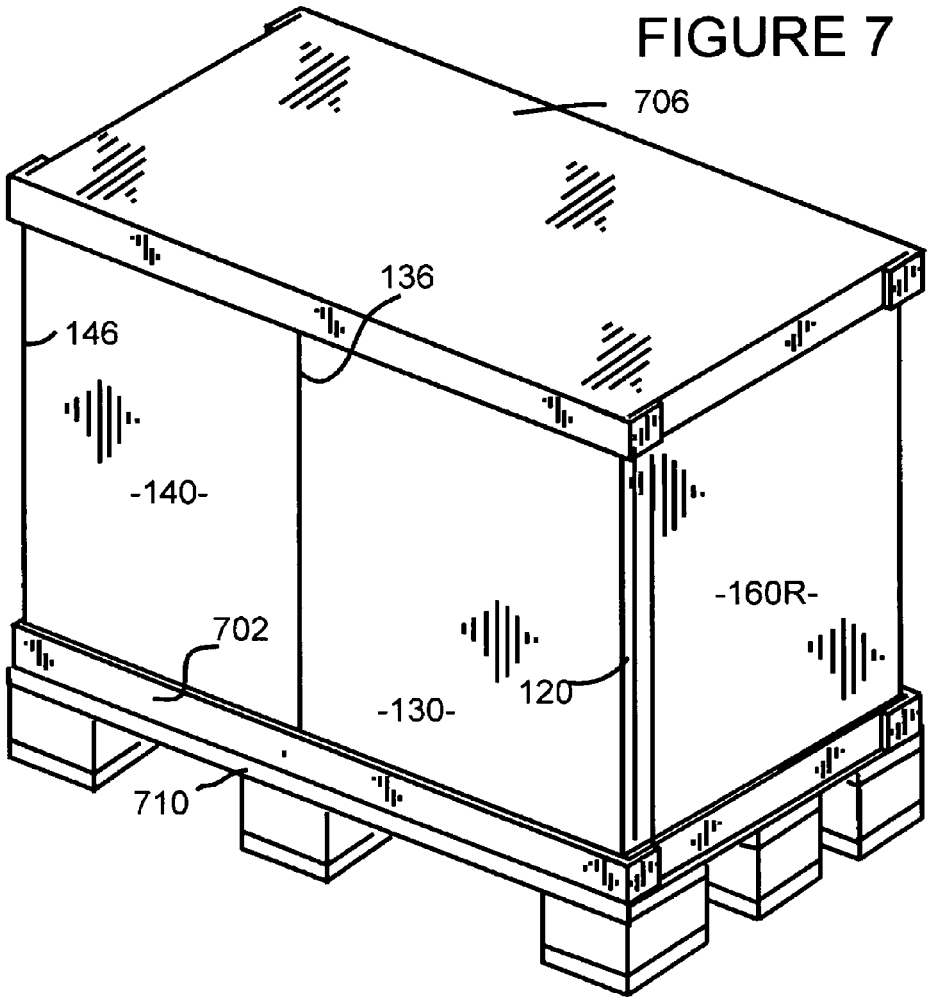
FIG. 7 is a perspective view of an embodiment showing an assembled crate, with upper and lower lids in accordance with and embodiment of the invention.

Once the panels 110 and 110R are assembled, the crate is completed as illustrated in FIG. 7. The crate 700 shows the panel 120 overlapped by overlap panel 160R, with the opposing end (not shown) having panel 150 overlapped by overlap panel 160. As can also be seen here, the score lines 146 and 126 are folded while center score line 136 remains unfolded. The base, or lower lid, 702 is dimensioned to receive the assembled panels 110 and 110R and provide the required lateral rigidity. Additional rigidity is provided by the top 706. In most embodiments the crate 700 will either be set upon a skid 510 that raises it from the ground. Alternatively, the crate 700 can be manufactured with feet as part of the lower lid 702.

Figure 8A:
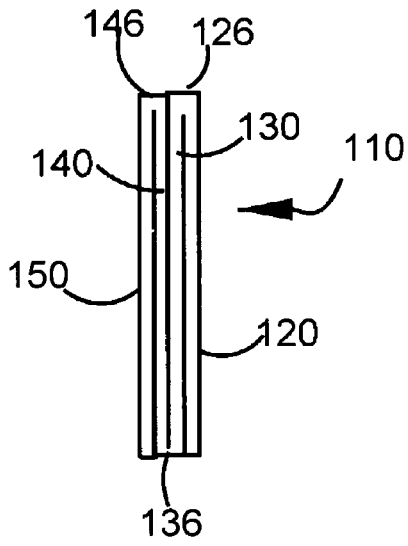
FIG. 8A is a plan view of an embodiment showing the wall panel of FIG. 2, in a folded form, for compact shipping in accordance with and embodiment of the invention.
Figure 8B:
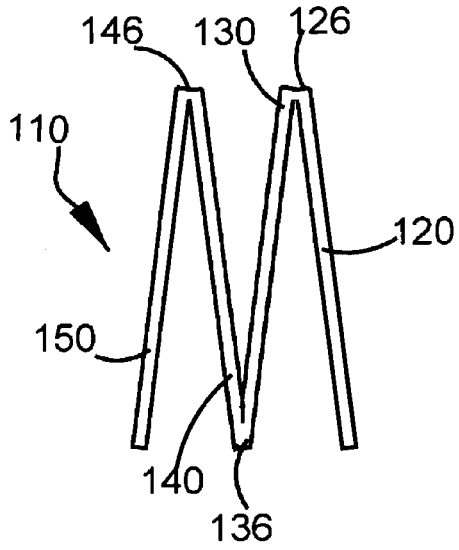
FIG. 8B is a plan view of the folded wall of FIG. 6A, being opened to the configuration of FIG. 2 in accordance with and embodiment of the invention.

In order to facilitate shipping, the panels 110 are folded into four equal sections as illustrated in FIGS. 8A and 8B. The ability to fold the panels 110 is enabled by the score lines 126, 136 and 146, which enables sub-panel 120 to lie adjacent to sub-panel 130; sub-panel 130 to lie adjacent to sub-panel 140 and sub-panel 140 to lie adjacent to sub-panel 150 as illustrated in FIG. 8A. Although the score line 136 is not used to bend the crate during assembly, it is critical to the ability to compactly ship the unassembled panels 110 on skids, within the top and bottom lids or in shipping crates. Upon reaching it destination is unfolded as illustrated in FIG. 6B, until it is once again in the configuration of FIG. 2. The fluted panels 134, 144, and 154 are shipped flat along with the panels 110 and can be assembled at the time of use.

An alternate embodiment of the shipping crate is illustrated in FIG. 9 wherein crate 900 has the end sub-panels 920 and 920R dimensioned shorter than the end sub-panels 950 and 950R. The remaining sub panels 930, 940 and 950 and the counterpart sub-panels 930R, 940R and 950R remain equal sizing and carry the horizontal fluted panels 934, 944, 954 and the counterpart horizontal fluted panels 934R, 944R, 954R. As with previous embodiments, the panels 910 and 901-R are folded at score lines 926R, 946R, 926 and 946. Score lines 936R and 936 (not shown) are not folded when assembled and are only used when the panels 110 are being shipped. The embodiment of FIG. 9 can also be folded and shipped flat as described heretofore.

Figure 10:
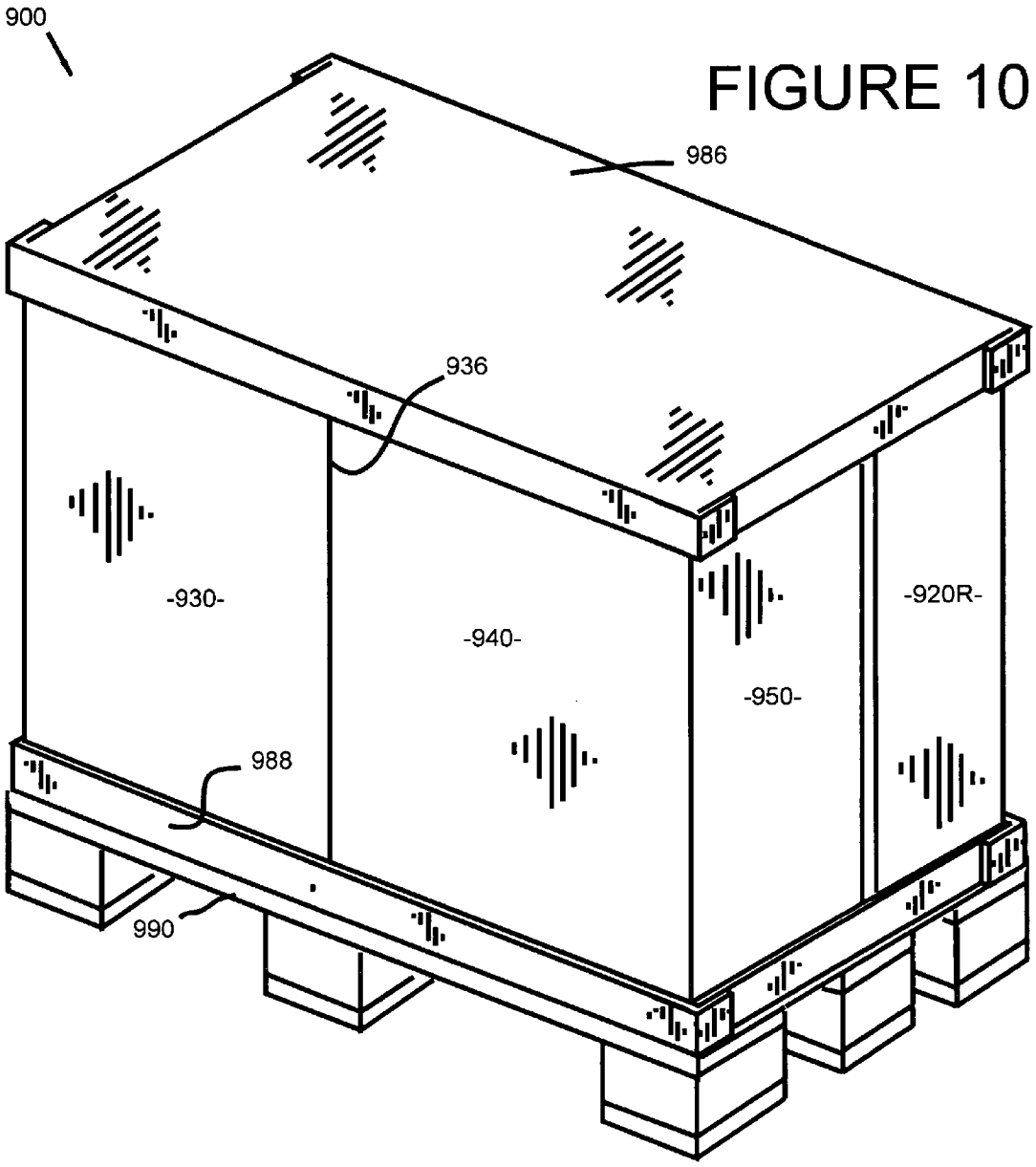
FIG. 10 is the fully assembled crate of FIG. 9 showing the different length end sub-panels in accordance with and embodiment of the invention.

The crate 900 in FIG. 10 has been assembled with the upper lid 986 and lower lid 988 in place. As seen in this embodiment the end sub-panel 920R is dimensioned to cover only a portion of the end sub-panel 950. As with prior embodiments, the score line 936, between sub-panels 940 and 930 is not folded. As described heretofore, the crate 900 is placed on a skid 900 or other structure to enable movement by forklift.

Figure 11:
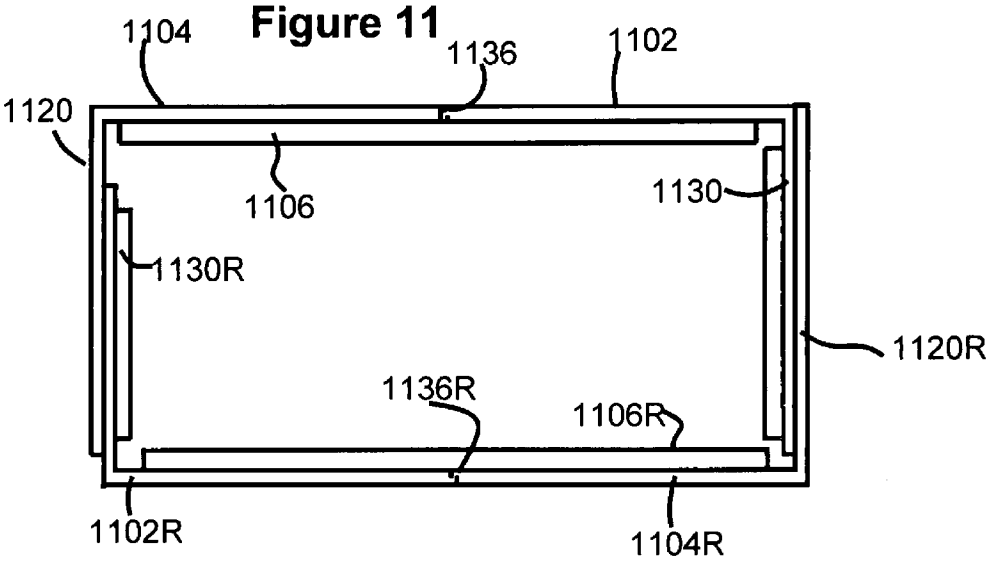
FIG. 11 is a top view of a crate having a horizontal fluted panel affixed to two of the sub-panel walls in accordance with and embodiment of the invention.

FIG. 11 shows an alternate embodiment in which single horizontal inner panels 1106 and 1106R spans the length of the interior of the sub-panels 1102, 1104, 1102R and 1104R and thus overlies the middle panels score lines 1136 and 1136R. In this embodiment the end sub-panels 1120, 1120R, 1130 and 1130R are substantially the same length.

Figure 12:
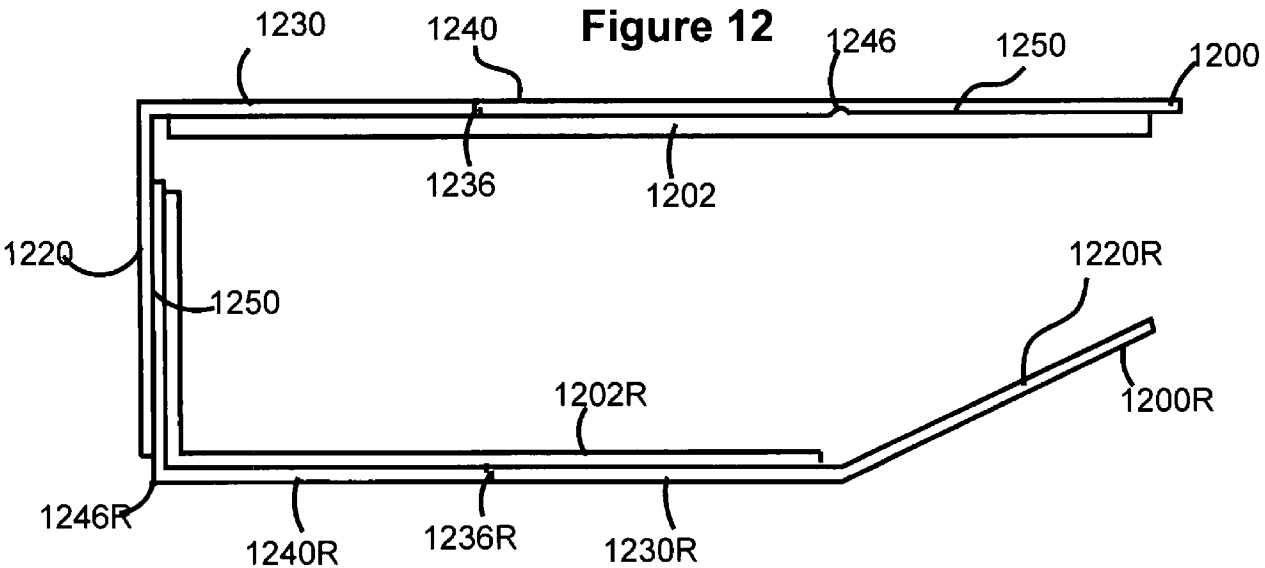
FIG. 12 is a top view of a crate having a horizontal fluted panel affixed to three of the sub-panel walls and where two end flaps are open in a door like fashion in accordance with an embodiment of the invention.

FIG. 12 shows an alternate embodiment in which a single horizontal panel 1202 spans the length of three of the sub-panels 1230, 1240, and 1250 of wall panel 1200, and two of the sub-panel score lines 1236 and 1246. The corresponding panel 1200R has three if the sub-panels 1230R, 124R, and 1250R spanned by single horizontal panel 1202R, covering score liens 1236R and 1246R. It should be noted that the sub-panels 1250 and 1220R can be left to open similar to a door to facilitate packing.

Figure 13:
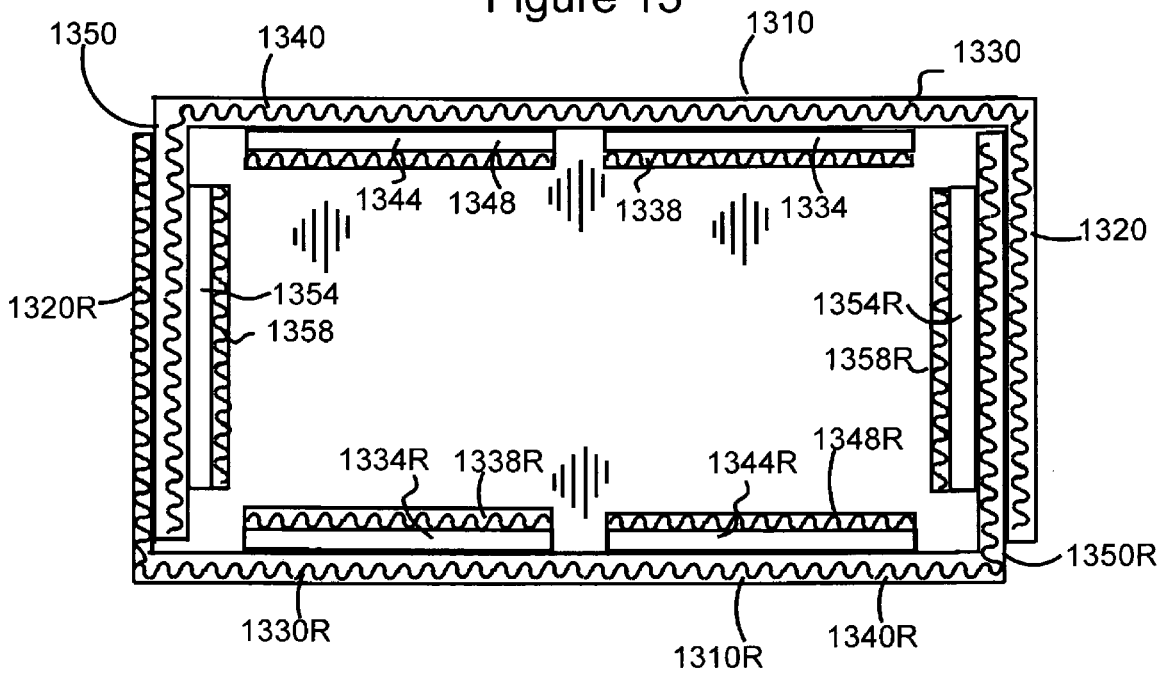
FIG. 13 is a top view of a crate having both horizontal and vertical fluted sections affixed to individual sub-panels.

FIG. 13 illustrates a further embodiment of the invention that provides substantially increased crush resistance. In this embodiment the panel 1310 is divided into sub-panels 1320, 1330, 1340 and 1350 and its counterpart panel 1310R is divided into sub-panels 1320R, 1330R, 1340R and 1350R. As previously described, horizontal fluted panels 1334, 1344 and 1354 are adhered to sub-panels 1330, 1340, 1350 and horizontal fluted panels 1334R, 1344R and 1354R are adhered to sub-panels 1330R, 1340R, 1350R. The end sub-panels 1320 and 1320R are substantially the same length as the sub-panels 1350 and 1350R. In this embodiment, however, additional vertical flute panels 1338, 1348 and 1358 are adhered to horizontal fluted panels 1334, 1344 and 1354 on the inner surface. Additional vertical flute panels 1338R, 1348R and 1358R are also adhered to the interior surface of horizontal fluted panels 1334R, 1344R and 1354R.

It is recognized that materials other than corrugated paper board can be used based on current technology and future improvements in technology. Corrugated plastic is not preferred because of ecological reasons, but from a structural standpoint, corrugated plastic and paper are equivalents. Recyclable plastics are preferred to plastics that are not readily recycled.

It is highly preferable that the two corrugated wall units in the foregoing embodiments are essentially identical. This provides an economy in the manufacture of the units and an advantage in that only one type of unit needs to be stored. It also provides ease of assembling of the crate since there is minimal chance for error.

The corrugated material for the horizontal panels may be triple wall, e.g. 600, 750, 900, 1100, or 1300 weight triple wall, etc. The corrugated material can also be a double wall, e.g. 275, 350, 500, 750 weight double, etc.

Similarly, a crate can be formed from two 12 by 7 foot panels having two outer subpanels that are about 8×7 and an inner sub-panel that is about 4×7 to produce a crate that is 8×4×7 and having overlying outer panels. The long sides thus have two overlaying panels.

The panel dimensions are selected such that at least two panel units are employed to form a crate. At least one panel has two or three subpanels and no panel has more than three subpanels. That is, no panel can form more than three sides of the crate. Two panels having three subpanels can be used, or four panels with two subpanels can be used. The shortest of the three panels, can serve as a door to provide ease of access to the crate interior.

The compression resistance of crates can be tested by using r ASTM D4169/D642. Failure of crates tested under ASTM D4169/D642, occurs when the crate compresses to any extent. The tests are all run to failure and since the tests are run in twenty pounds increments, the compression prior to failure, that is, the maximum compression strength, is twenty pounds less than compression at failure.

Testing of the Compression Strength of Different Combinations of Corrugated Board

| COMBINATION | # compression | Deflection | Notes |
|---|---|---|---|
| 1-1300-1300 triple-triple wall | 12960 | 2.16 | 27% more expensive |
| 2-1100-1100 triple-triple wall | 13500 | 2.08 | 4% stronger |
| 3-1300-500-1300 TW-DW-TW | 18060 | 1.72 | 18.3% more expensive |
| 4-1100-500-1100 TW DW TW | 22710 | — | 25.6% stronger |
| 5-1300-500 triple-double | 11190 | 1.92" | 24.7% more expensive |
| 6-1100-500 triple-double | 13950 | 2.30" | 24.7% stronger |

All tests were conducted with crates having the same crate design.

DW refers to double wall corrugated.

TW refers to triple wall corrugated.

The combination of Test 1 employs material that is 27% more expensive than the material of Test 2. Nevertheless, the combination of Test 2 is 4% stronger than the combination of Test 1.

The combination of Test 2 is 18.3% more expensive than the material of Test 4. Contrary to conventional wisdom the combination of Test 4 is 4% stronger than the combination of Test 3.

The combination of Test 5 is 24.7% more expensive than the material of Test 6. Contrary to conventional wisdom the combination of Test 6 is 4% stronger than the combination of Test 5.

In tests 1 and 2 the crate panels are all vertical/vertical.

In tests 3 and 4, the triple layered corrugated is vertical.

In all tests the 500 double wall horizontal panels have flutes that are horizontally relative to the vertical flutes of the wall panels.

The tests were conducted by an independent testing laboratory.

The test results show that the horizontal/vertical fluting of tests 5 and 6 are stronger than the triple wall crates of test 1 and 2. The unusual results are attributed to the use of the horizontal fluting to keep the vertical fluting from bowing.

The use of horizontally fluted panels adhered to the vertically oriented wall panel, provides a less expense, as well as a higher crush strength crate.

The higher crush strength of the 1100 triple wall compared to 1300 triple wall is attributed to the lighter weight material being less likely to bow. The lighter weight paper seems to relax and maintain unbowed. Perhaps the 1100 was easier for the 500 DW horizontal fluting to keep from bowing. The explanation for the unusual results is presented only for guidance and general knowledge but is not a part of the inventions described herein The results are unusual, contrary to common logic, and therefore an explanation of the tests showing the reverse of what would be expected is not a limitation of the invention Other explanations may come to light in the future.

All documents, patents, journal articles and other materials cited in the present application are herein incorporated by reference.

Broad Scope of the Invention

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims (e.g., including that to be later added) are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example".

What is claimed is:

1. A substantially rectangular crate having four exterior side panels, said four side panels being formed of at least a single rectangular length of corrugated material, said material being at least 800 weight triple layer corrugated paper, a plurality of inner panels adhered to the interior surface of said exterior panels, said interior panels being 700 lbs or less corrugated paper where weight is in lbs per 1000 sq. feet.

2. The crate of claim 1, said exterior side panels being triple wall corrugated paper having a weight of at least 1100.

3. The crate of claim 1, wherein the flutes in the outer layer run vertically, and the flutes in the inner panels run horizontally.

4. The crate of claim 1, wherein said four exterior side panels are double wall or triple wall, vertically oriented corrugated, and the inner panel are double wall horizontally oriented corrugated.

5. The crate of claim 1, said exterior side panels being triple wall corrugated paper having a weight of about 1100 pounds.

6. The crate of claim 1, said interior side panels being double wall corrugated paper having a weight of 500 pounds.

7. The crate of claim 5, said exterior side panels being double wall corrugated paper having a weight of 500 pounds.

8. A substantially rectangular crate having four exterior side panels, said four side panels being formed of at least a single rectangular length of corrugated material, said material exterior side panels having vertical flutes, a plurality of inner panels adhered to the interior surface of said exterior panels, said interior panels having horizontal flutes, and wherein the exterior side panel have a greater weight per 1000 square feet than the inner panel.

9. The crate of claim 8, said exterior side panels being triple wall corrugated paper having a weight in the range from 900 to 1200 lbs per 1000 sq. feet.

10. The crate of claim 8, said exterior side panels being triple wall corrugated paper having a weight on the order of about 1100 pounds lbs per 1000 sq. feet.

11. The crate of claim 8, said interior side panels being double wall corrugated paper having a weight on the order of about 500 pounds lbs per 1000 sq. feet.

12. The crate of claim 10, said exterior side panels being double wall corrugated paper having a weight of 500 pounds lbs per 1000 sq. feet.

13. A substantially rectangular crate having four exterior contiguous side panels, said four side panels being formed of a single rectangular length of corrugated material, said material being at least 800 weight triple layer corrugated paper, a plurality of inner panels adhered to the interior surface of said exterior panels, said interior panels being 700 lbs or less corrugated paper where weight is in lbs per 1000 sq. feet.

14. A crate having:

a planar end cap, said end cap having two side flaps and two end flaps, four side walls, said side walls comprising:

a first panel and a second panel, said first panel and second panel each of having vertical flutes, said first panel and said second panel forming said four side walls, said first panel having a first, a second, and a third subpanel, second panel having a first, a second and a third subpanel, said first subpanel of said first panel overlapping the exterior side of said third subpanel of said second panel, said first subpanel of said second panel overlapping the exterior side of said third subpanel of said first panel, said second subpanel of said first panel and said second subpanel of said second panel having substantially identical dimensions, said first subpanel of said first panel and said first panel of said second panel have substantially identical dimensions, and said third subpanel of said first and said second panel having substantially identical dimensions, said first subpanel of said first panel being between a first of said two end flaps of said end cap and said third sub panel of said second panel, said first subpanel of said second panel being between a second of said two end flaps of said end cap and said third subpanel of said first panel, each said first subpanels having a width at least slightly less than the width of each of said third subpanel, and said third panel of said first panel having a width that extends from its contiguous second panel to the interior surface of said second subpanel of said second panel, said first subpanel of said first panel being releasably secured between said third subpanel of said second panel and one of said end flaps of said end cap, wherein said second subpanel of said first panel and said second subpanel of said second panel are two opposing walls of said four side walls, and said third subpanel of said first panel and said third subpanel of said second panel are the other two opposing walls of said four side walls, and a plurality of inner panels adhered to the interior surface of said first panel and said second panel, said interior panels having horizontal flutes.

15. The crate of claim 14, further comprising each said first subpanels having a width less than half the width of each of said third subpanels.

16. The crate of claim 14, further comprising strapping means, said first subpanel of panel being releasably secured between said third subpanel of said second panel and one of said end flaps of said planar end cap by said strapping means.

17. The crate of claim 16, further comprising a second end cap, said first subpanel of said first panel being releasably secured between said third subpanel of said second panel and one of said end flaps of said second cap by said strapping means.

18. The crate of claim 16 wherein said first sub panel of said second panel is rotatably contiguous with the second subpanel of the second panel, and said first subpanel of said first panel is rotatably contiguous with the second subpanel of said second panel.

19. The crate of claim 14, wherein said first panel and said second panel are double wall or triple wall, vertically oriented corrugated, and the inner panel are double wall horizontally oriented corrugated.

* * * * *